US008267725B2

(12) United States Patent
Zhu

(10) Patent No.: US 8,267,725 B2
(45) Date of Patent: Sep. 18, 2012

(54) ELECTRICAL CONNECTOR WITH HIGH INTENSITY CONTACTS

(75) Inventor: Yu Zhu, Shenzhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/072,786

(22) Filed: Mar. 28, 2011

(65) Prior Publication Data

US 2012/0052733 A1 Mar. 1, 2012

(30) Foreign Application Priority Data

Sep. 1, 2010 (CN) ..... 201020513035.2

(51) Int. Cl.
*H01R 13/40* (2006.01)

(52) U.S. Cl. ..... 439/660; 439/862

(58) Field of Classification Search ..... 439/660, 439/862
See application file for complete search history.

(56) References Cited

U.S. PATENT DOCUMENTS

| | | | | |
|---|---|---|---|---|
| 6,315,621 | B1 * | 11/2001 | Natori et al. | 439/862 |
| 7,297,010 | B2 * | 11/2007 | Tsai | 439/331 |
| 7,341,485 | B2 * | 3/2008 | Polnyi | 439/591 |
| 7,402,088 | B2 * | 7/2008 | Hsu et al. | 439/862 |
| 7,559,811 | B1 * | 7/2009 | Polnyi | 439/862 |
| 7,625,217 | B1 * | 12/2009 | Liao | 439/66 |
| 7,981,539 | B2 * | 7/2011 | Lai | 429/159 |
| 2003/0104731 | A1 * | 6/2003 | Chang | 439/862 |

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

An electrical connector includes an insulative housing defining a mating surface, a mounting surface and a plurality of passageways running through the mating surface and the mounting surface and a plurality of contacts upwardly assembled into the corresponding passageways. Each of the contacts defines an upright retention portion interfered with the passageway, a pair of elastic arms extending from the retention portion and spaced apart with each other and a lying V-shaped contacting portion formed by a distal end of each elastic arms bending and extending beyond the mating surface of the housing. Each contact defines a connecting portion connecting with the pair of elastic arms and received in the passageway.

15 Claims, 4 Drawing Sheets

ELECTRICAL CONNECTOR WITH HIGH INTENSITY CONTACTS

BACKGROUND OF THE INVENTION

1. Field of the Invention

The present invention generally relates to an electrical connector, and more particularly, to a novel structure of an electrical connector with contacts prevented from deformation.

2. Description of Related Art

An electrical connector includes an insulative housing and a plurality of contacts upwardly secured into passageways of the insulative housing. Each contact defines a retention portion interfered with the passageway, a contacting portion protruding from a mating face of the insulative housing and an elastic portion receiving in the receiving passageway and connecting with the contacting portion and the retention portion. In a process of the electrical connector mating with a complementary connector, a lateral pressing force is exerted on the contacting portions to result the contacting portions moving to the mating face. The pressing force is also exerted on the elastic portions to result in deformation of the elastic portions. Thus, an electrical connector with contacts prevented from deformation is desired to overcome the disadvantages of the related art.

Hence, the present invention is directed to solving this problem in the related art.

SUMMARY OF THE INVENTION

An object of the invention is to provide an electrical connector with improved contacts prevented from deformation and improving intensity.

In order to achieve the object set forth, an electrical connector includes an insulative housing defining a mating surface, a mounting surface and a plurality of passageways running through the mating surface and the mounting surface and a plurality of contacts upwardly assembled into the corresponding passageways. Each of the contacts defines an upright retention portion interfered with the passageway, a pair of elastic arms extending from the retention portion and spaced apart with each other and a lying V-shaped contacting portion formed by a distal end of each elastic arms bending and extending beyond the mating surface of the housing. Each contact defines a connecting portion connecting with the pair of elastic arms and received in the passageway.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
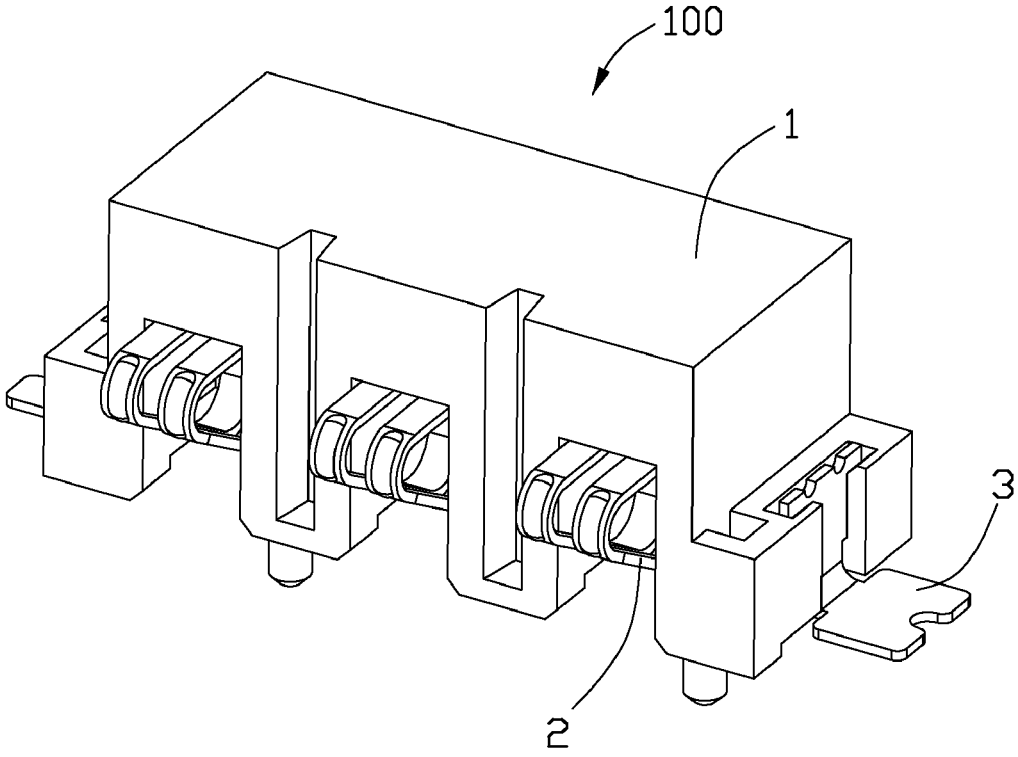
FIG. 1 is a perspective view of an electrical connector of an embodiment of the present invention.

Referring to FIG. 1, an electrical connector 1 in accordance with an embodiment of the present invention is a battery connector. The connector 100 comprises a rectangle insulative housing 1, a plurality of elastic contacts 2 secured in the insulative housing 1 and a pair of soldering pads 3 disposed at two sides of the insulative housing 1.

Figure 2:
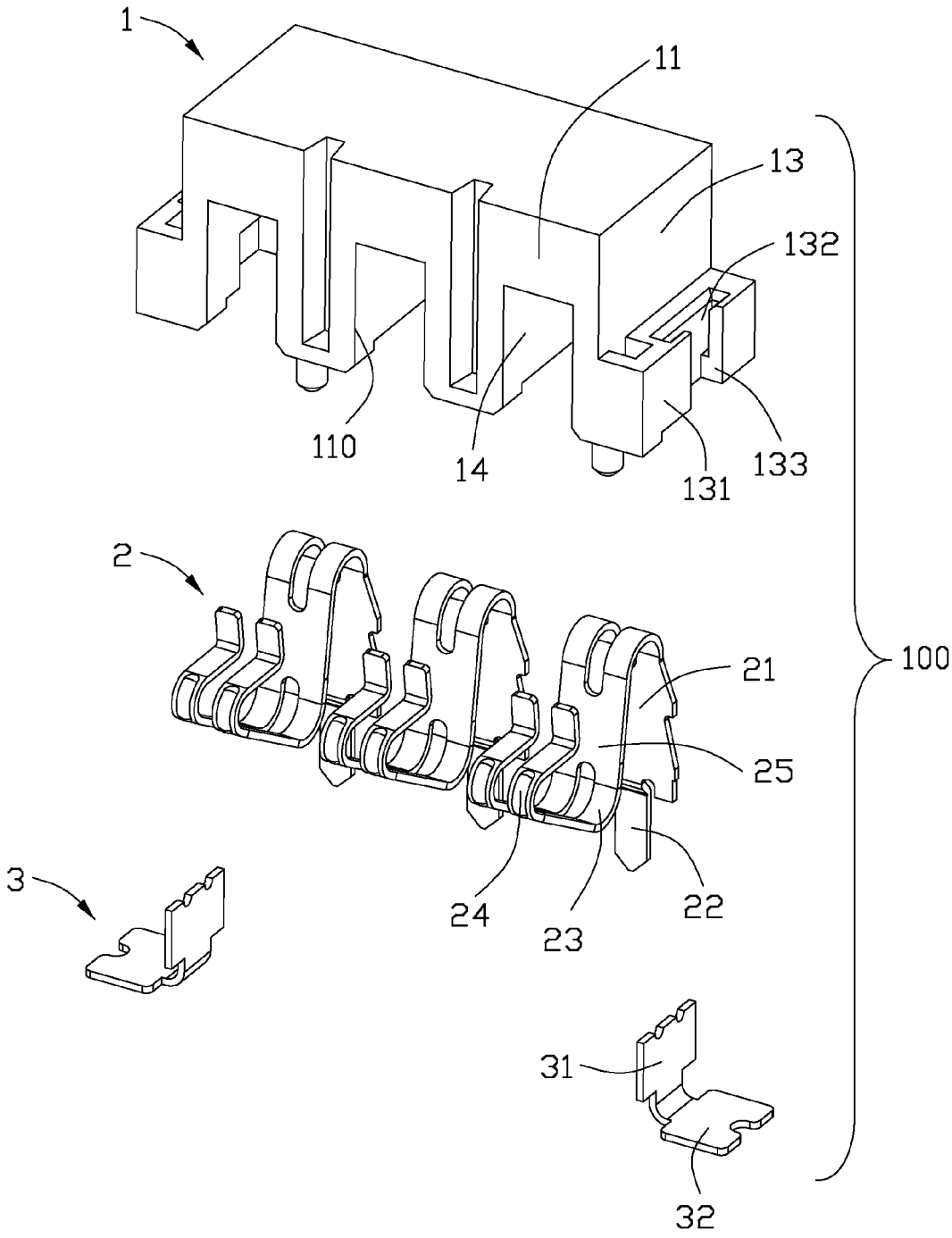
FIG. 2 is an exploded perspective view of the electrical connector as shown in FIG. 1.
Figure 3:
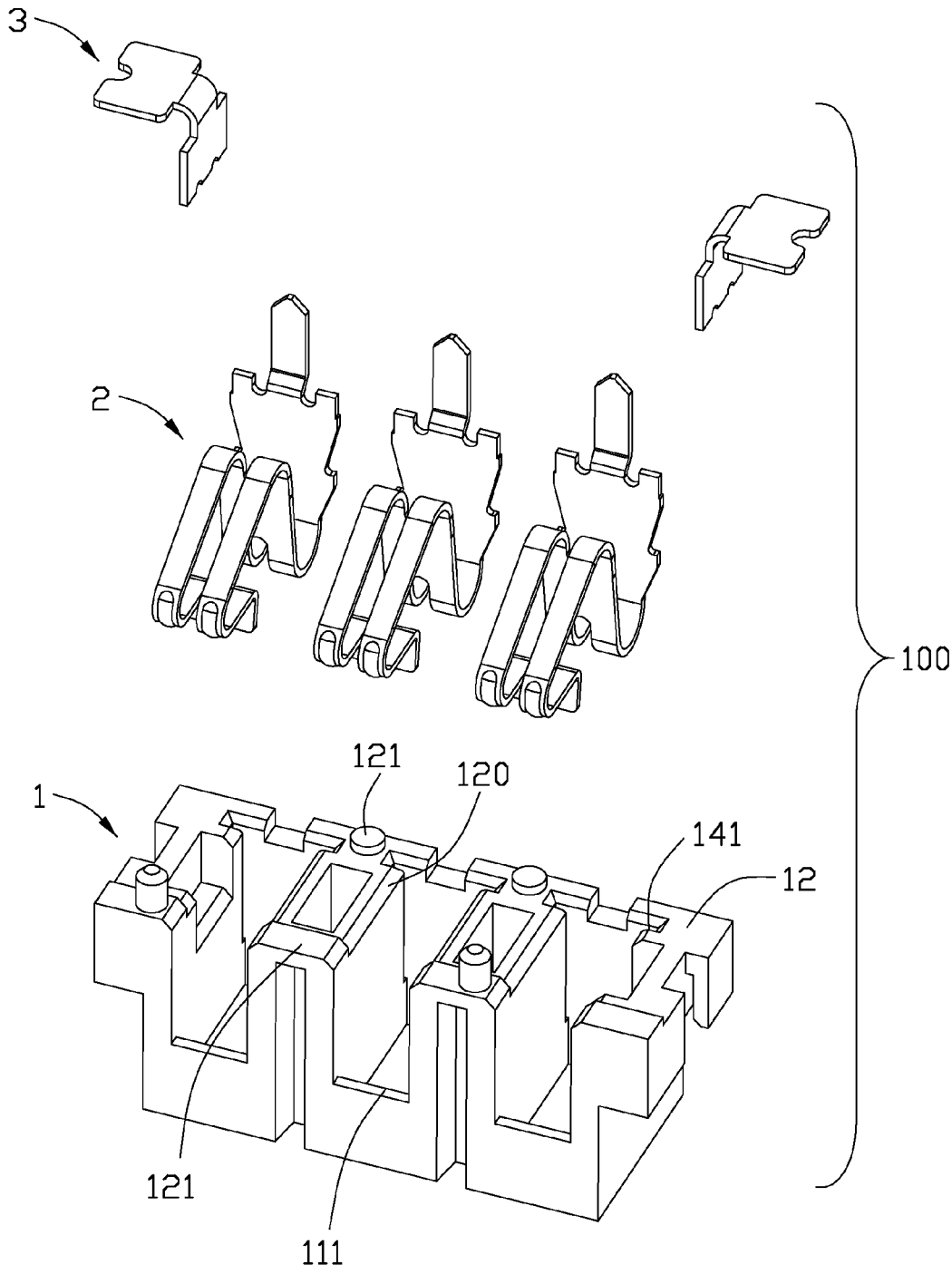
FIG. 3 is a view similar to FIG. 2, while taken from a different aspect.

Referring to FIGS. 2 and 3, the insulative housing 1 defines a mating surface 11 intended for confronting with a complementary connector (not shown), a mounting surface 12 perpendicular to the mating surface 11 and two side surfaces 13 connecting with the mating surface 11 and the mounting surface 12. A plurality of passageway 14 running through the mating surface 11 and the mounting surface 12. Each passageway 14 has a front opening 110 formed at the mating surface 11 and a bottom opening 120 formed at the mounting surface 12. The contacts 2 are assembled into corresponding passageways from the bottom openings 120 and protrude out of the front opening 110. Each passageway 14 further defines a pair of positioning slots 141 defined at two sides thereof and opposite to the front opening 110 for retaining the contact 2. The insulative housing 1 defines a pair of mounting portions 131 respectively extending sideward from the side surface 13 for retaining the soldering pad 3. The mounting portion 131 has a mounting slot 132 extending therethrough in an up-to-down direction and extending through the mounting surface 12. A side opening 133 is defined at a side surface of the mounting portion 131 and extending through the mounting slot 132 for facilitating assembly or dismantling of the soldering pad 3. The insulative housing 1 defines a plurality of stand-off 121 extending downwardly from the mounting surface 12 and located at two sides of the mounting surface 12 along a lateral direction for prevent the housing 1 from deformation after soldering.

Figure 4:
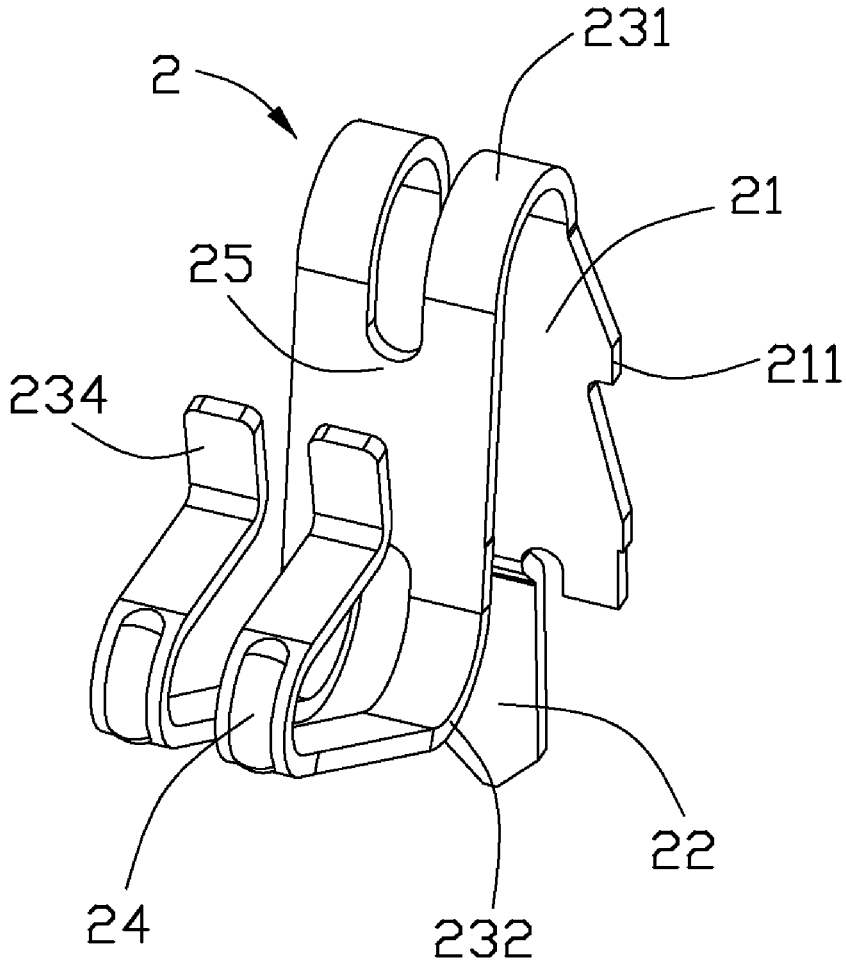
FIG. 4 is a perspective view of a contact of the electrical connector as shown in FIG. 1.

Referring to FIGS. 2 and 4, each of the contacts 2 is stamped from a metallic plate and upwardly assembled into the passageway 14 of the insulative housing 1. Each contact 2 defines an upright retention portion 21 interfered with the positioning slot 141 of the passageway 14 and perpendicular to the mounting surface 12, a soldering portion 22 extending from one end of the retention portion 21 and through the mounting surface 12 vertically, a pair of elastic arms 23 extending forward from the other end of the retention portion and spaced apart with each other and a lying V-shaped contacting portion 24 bending from a distal end of each elastic arm 23 and extending beyond the mating surface 11 of the housing 1. Each contact 2 further has a connecting portion 25 connecting with the pair of elastic arms 23 for improving intensity of the contact 2 and preventing the two elastic arms from excessive deformation, and located at a position between the contacting portion 24 and the retention portion 21. The pair of elastic arms 23 receives in the passageway 14 and each has a first curve portion 231 bending from the retention portion 21 and extending toward the mounting surface 12 and a second curve portion 232 bending from the first curve portion 231 and extending far away the mounting surface 12. The contacting portion 24 bends sideward from the second curve portion 232 and protrudes out of the mating surface 11. A distal end of the contacting portion 24 extends into the passageway 14 and toward the retention portion 21. A stop portion 234 extends upwardly from the distal end of the contacting portion 24 and abuts against an inner face 111 of the front opening 110 for restricting the contacting portion 24 to moving. The stop portion 234 is lower than the first curve portion 231. The connecting portion 25 is between the first curve portion 231 and the second curve portion 232 for reducing elastic deformation of the elastic arms 23. The retention portion 21 defines a pair of interferential portions 211 at two sides thereof and interfered with the positioning slot 141 for retaining the contact 2 in the passageway.

Referring to FIGS. 1 and 2, the pair of soldering pads 3 is upwardly assembled into the mounting slots 132 of the mounting portions 131. Each soldering pad 3 is L-shaped and defines an upright portion 31 interferential with the mounting slot 108 and a horizontal portion 32 perpendicular to the upright portion 31 and used to be sealed on a printed circuit board.

In the invention, the contact 2 defines a connecting portion 25 connecting with the pair of elastic arms and between the first curve portion 231 and the second curve portion 232 for preventing the contacts from excessive deformation or damaging. It can overcome the disadvantages of the contact in industry.

The present invention will now be described in detail with reference to a preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

What is claimed is:

1. An electrical connector comprising:

an insulative housing defining a mating surface, a mounting surface and a plurality of passageways running through the mating surface and the mounting surface;

a plurality of contacts assembled into the corresponding passageways from the mounting surface, each of the contacts defining an upright retention portion interfered with the passageway, a pair of elastic arms extending from the retention portion and spaced apart with each other and a lying V-shaped contacting portion formed by a distal end of each elastic arms bending and extending beyond the mating surface of the housing;

wherein each contact defines a connecting portion connecting the pair of elastic arms and received in the passageway.

2. The electrical connector as claimed in claim 1, wherein each elastic arm defines a first curve portion bending from the retention portion and extending toward the mounting surface and a second curve portion bending from the first curve portion and extending away from the mounting surface, the contacting portion bends from the second curve portion and a distal end thereof extending into the passageway.

3. The electrical connector as claimed in claim 2, wherein the connecting portion is between the first curve portion and the second curve portion.

4. The electrical connector as claimed in claim 3, wherein each contact further defines a stop portion extending from the distal end of the contacting portion, each passageway has a front opening formed at the mating surface and a bottom opening formed at the mounting surface, the stop portion abuts against an inner face of the front opening.

5. The electrical connector as claimed in claim 4, wherein each contact defines a soldering portion extending from the retention portion and through the mounting surface.

6. The electrical connector as claimed in claim 1, wherein the mating surface is perpendicular to the mounting surface, and the retention portion is perpendicular to the mounting surface.

7. An electrical connector comprising:

an insulative housing defining a mating surface, a mounting surface and a plurality of passageways running through the mating surface and the mounting surface;

a plurality of contacts assembled into the corresponding passageways from the mounting surface, each contact comprising a retention portion with barbs retained in an inside face of the passageway opposite to the mating surface, a pair of parallel elastic arms bending from the retention portion with a pair of contacting portions projecting beyond the mating surface of the insulative housing;

wherein the pair of elastic arms of each contact is connected with each other by a connecting portion integrally formed between the pair of elastic arms in a direction along which the contacts are arranged.

8. The electrical connector as claimed in claim 7, wherein the connecting portion is disposed at a horizontal section connecting to the retention portion.

9. The electrical connector as claimed in claim 8, wherein the connecting portion is disposed in a middle portion of the horizontal section.

10. An electrical connector comprising:

an insulative housing defining a longitudinal direction and a mating direction perpendicular to each other;

a plurality of passageways formed in the housing along said longitudinal direction, each of said passageways communicating with an exterior in the mating direction and a downward direction perpendicular to said mating direction and said longitudinal direction; and a plurality of contacts disposed in the corresponding passageways, respectively, each of said contacts defining a retaining section, a tail section extending unitarily from a bottom portion of the upstanding retaining section, a pair of curved contacting arms spaced from each other in a parallel relation while commonly extending unitarily from a top portion of the retaining section, said each of contacting arms defining an upper curved portion extending from the upper portion of the retaining section and a lower curved portion adjacent to a bottom face of the housing, and a contacting portion extending from the lower curved portion and beyond a front face of the housing for mating with a complementary connector; wherein the pair of contacting arms are joined with each other via a connecting portion in the longitudinal direction.

11. The electrical connector as claimed in claim 10, wherein the connecting portion is located positions of said pair of contacting arms between the upper curved portion and the lower curved portion.

12. The electrical connector as claimed in claim 10, wherein each of said contacting arms is further equipped with a stop portion at a free end for forwardly abutment with the housing behind the front face so as to prevent excessive forward movement of the contacting portion.

13. The electrical connector as claimed in claim 12, wherein said stop portions of the pair of contacting arms are not joined together in the longitudinal direction.

14. The electrical connector as claimed in claim 10, wherein each of the contacts is upwardly assembled into the corresponding passageway.

15. The electrical connector as claimed in claim 10, wherein the upper curved portion and the lower curved portion are offset from each other in both the mating direction and the downward direction.

* * * * *